United States Patent [19]

Lachenal et al.

[11] Patent Number: 4,787,959

[45] Date of Patent: Nov. 29, 1988

[54] PROCESS FOR PREPARING CHEMICAL PAPER PULPS BY COOKING, INTERMEDIATE GRINDING AND A FINAL ALKALINE PEROXIDE DELIGNIFICATION

[75] Inventors: Dominique Lachenal, Grenoble; Christian de Choudens, Gieres; Pierre Monzie, Grenoble, all of France

[73] Assignee: Atochem, Paris, France

[21] Appl. No.: 122,593

[22] Filed: Nov. 18, 1987

Related U.S. Application Data

[63] Continuation-in-part of Ser. No. 886,947, Jul. 23, 1986, abandoned, which is a continuation-in-part of Ser. No. 362,163, Mar. 26, 1982, abandoned, which is a continuation of Ser. No. 138,294, Apr. 11, 1980, abandoned, which is a continuation of Ser. No. 928,891, Jul. 28, 1978, abandoned.

[30] Foreign Application Priority Data

Jul. 29, 1977 [FR] France ..... 77 24137
Jul. 5, 1978 [FR] France ..... 78 20715

[51] Int. Cl.[4] ..... D21C 3/02; D21C 3/20; D21C 3/26; D21C 9/16

[52] U.S. Cl. ..... 162/25; 162/72; 162/78; 162/90

[58] Field of Search ..... 162/24, 25, 78, 90, 162/28, 72, 19

[56] References Cited

U.S. PATENT DOCUMENTS

| | | | |
|---|---|---|---|
| 1,890,179 | 12/1932 | Helder | 162/25 |
| 2,487,114 | 11/1949 | Dreyfus | 162/25 |
| 2,527,563 | 10/1950 | McEwen | 162/78 |
| 3,650,887 | 3/1972 | Grangaard | 162/78 |
| 4,012,280 | 3/1977 | Holton | 162/90 |
| 4,294,653 | 10/1981 | Lindahl | 162/28 |

FOREIGN PATENT DOCUMENTS

| | | | |
|---|---|---|---|
| 2540919 | 4/1976 | Fed. Rep. of Germany | 162/24 |
| 0558081 | 6/1977 | U.S.S.R. | 162/78 |
| 0576510 | 4/1946 | United Kingdom | 162/25 |

*Primary Examiner*—Steve Alvo
*Attorney, Agent, or Firm*—Pennie & Edmonds

[57] ABSTRACT

A process of preparing new chemical paper pulps wherein a first cooking stage is effected in the presence of sodium hydroxide and advantageously adjuvants, after which an intermediate grinding is effected and followed by a second cooking stage characterized in that the second cooking stage is performed in the presence of a peroxide alkaline solution containing a peroxide stabilizing agent.

15 Claims, No Drawings

PROCESS FOR PREPARING CHEMICAL PAPER PULPS BY COOKING, INTERMEDIATE GRINDING AND A FINAL ALKALINE PEROXIDE DELIGNIFICATION

This application is a continuation-in-part of application Ser. No. 886,947, filed July 23, 1986, abandoned, which is a continuation-in-part of application Ser. No. 362,163, filed Mar. 26, 1982, abandoned, which is a continuation of application Ser. No. 138,294 filed Apr. 11, 1980, abandoned, which is a continuation of application of Ser. No. 928,891 filed July 28, 1978, abandoned.

FIELD OF THE INVENTION

The present invention relates to a new process of making improved paper pulps known as chemical pulps in which the delignification of a lignin-cellulose raw material is performed by a cooking in two stages, the second stage being performed by a peroxide alkaline solution.

BACKGROUND OF THE INVENTION

Numerous attempts are being made in the art of delignification of lignin-cellulose raw materials to meet the new requirements of regulations designed for protecting the environment. In particular, these regulations have incited papermakers to try to replace certain papermaking processes that are particularly polluting by processes able to produce pulps with equivalent characteristics without pollution.

This problem takes on a particular acuteness in regard to chemical pulp known as kraft, which exhibits characteristics on a very high level, but whose manufacturing process is particularly polluting. The kraft process, as it is well known, generates atmospheric pollution by release of foul-smelling sulfur compounds such as mercaptans, sulfur dioxide, hydrogen sulfide, or the like. Further, the resulting pulps require a subsequent thorough bleaching to achieve the level of whiteness necessary for specialized uses such as treatment with chlorine agents, which themselves are water pollutants.

To solve these problems, paper research has been particularly oriented toward the use of delignification agents that are not pollutants and, during their action on the lignin, do not cause pollutant products. Thus, cooking processes have been developed that take advantage of the delignification action of oxygen in an alkaline medium.

One such process consists essentially of a cooking of the lignin-cellulose material in two stages, separated by an intermediate grinding, successively comprising an alkaline cooking under pressure, an intermediate grinding in a disk apparatus, and finally a cooking under oxygen pressure in the presence of an alkaline solution. An example of the process is described in Canadian Pat. No. 895,756. Although this process yields a good quality pulp, without causing atmospheric pollution, the process has a certain number of drawbacks. On the one hand, the slight solubility of the oxygen requires steps to assure a rather homogeneous transfer between the gaseous phase, aqueous phase and cellulose fibers. The use of relatively high pressures, such as on the order of eight (8) to ten (10) bars with requirements up to twenty (20) bars, requires use of special burdensome equipment different from that used for the standard kraft process. To replace the kraft process by an oxygen process involves extremely heavy machinery and investments even for small and medium size units.

The quality of pulps obtained by the oxygen processes is slightly inferior to those of the kraft pulp, particularly because of the depolymerizing action of the oxygen on the cellulose. Most studies published on this subject tend to agree on recognizing this lower level of the mechanical characteristics and particularly the tear index. In this connection, there can be cited the publications of A. G. Jamieson, O. Samuelson, L. A. Smedman in *Technical Association of Pulp & Paper Industry* (TAPPI), Volume 58, No. 2, pp. 68–71; M. Saukkonen and I. Paulenius in TAPPI, Volume 58, No. 7, pp. 117–120; H. M. Chang, J. S. Gratzl, W. T. McKean, R. H. Reeves, and V. E. Stockman in TAPPI, Volume 59, No. 8, pp. 72–75.

In their most recent versions, the processes cited above have involved lower oxygen pressures and the corresponding reduction in machinery investments. Elimination of the intermediate grinding has been proposed in French Pat. No. 2,256,283, while improvement of the oxygen transfer has been proposed in French Pat. No. 2,220,620.

The investments necessary for the application of oxygen processing are still clearly greater than those of the kraft process, without improving the characteristics of the pulps being processed. Further, the lower level of the tearing index is particularly disadvantageous for using these pulps in the field of wrapping papers.

These differences explain why so far few of the prior art attempts have resulted in an industrial commercialization.

It has now been found that by practice of the present invention, the difficulties and disadvantages of prior art attempts to remove pollution contaminants from paper pulp processing have been overcome in a simple, highly efficient manner.

SUMMARY OF THE INVENTION

The present invention, generally stated, relates to a process for making paper pulp by chemical delignification of lignin-cellulose raw material by two-stage cooking, the second cooking stage being performed in the presence of a peroxide alkaline solution.

It is an object of this invention to process paper pulp in a simple, efficient manner while eliminating disposal problems and adverse ecological and environmental effects.

It is also an object of this invention to prepare paper pulp in an efficient, relatively inexpensive manner by means of a second stage cooking in the presence of a peroxide alkaline solution.

It is another object of this invention to avoid prior art problems in paper pulp processing, both in regard to the processing and the characteristics of the resulting pulps.

These objects, as well as additional objects and advantages, will become more apparent from the following more detailed description of the preferred embodiments.

DETAILED DESCRIPTION OF THE PREFERRED EMBODIMENTS

The present process of making chemical paper pulps comprising a first cooking stage in the presence of sodium hydroxide and advantageously adjuvants, an intermediate grinding and a second cooking stage characterized in that the second cooking stage is performed in the presence of a peroxide alkaline solution containing a peroxide stabilizing agent.

The process consists of a non-polluting, two-stage cooking of lignin-cellulose materials with sodium hydroxide and peroxide. This process exhibits the desired qualities of effectiveness and simplicity and can be applied with relatively simple existing industrial equipment. It makes it possible to obtain pulps having high mechanical properties, possessing a good bleaching capacity, and with a yield as high as that obtained by the standard processes used so far.

The process according to the invention consists of subjecting cellulose material to the conventional first cooking stage in the presence of sodium hydroxide to which possibly adjuvants may have been added, then in grinding the material thus treated, and finally subjecting this ground material to a second cooking stage. In the second stage, the invention is characterized in that the second cooking stage is performed in the presence of a peroxide alkaline solution. Advantageously, the treatment is performed at atmospheric pressure and preferably at a temperature less than 100° C.

This process can be applied to any lignin-cellulose raw material, such as deciduous or coniferous trees, bagasse, great reed, straw, kenaf, or the like.

To perform the first cooking stage, in a manner known in itself, the cellulose material, reduced to fragments under the usual conditions, is put in contact with an aqueous soda solution containing from about 10 to about 30% by weight soda based on the weight of sodium hydroxide in relation to the vegetal dry weight material initially used. The cooking is effected at a high temperature such as between about 150° and about 180° C.

It has been found presently that particularly advantageous results are obtained in pulp processing and under particularly advantageous conditions when the second cooking stage is applied to lignin-cellulose materials that have undergone a first cooking stage in the presence of sodium hydroxide to which adjuvants may have been added such as certain aromatic nitro derivatives, certain nitrogen heterocyclic compounds of the phenazine type, and cyclic ketones of the anthraquinone type. The amounts of adjuvants to be used are particularly limited, for example, from about 0.01% to about 0.2% of anthraquinone in relation to the weight of the starting dry plant.

The period of time for the first cooking stage varies with the values chosen for other heat processing parameters, and with the nature of the wood or plant material used.

The cooking time should be sufficient for the cooked chips to be able to be ground in a standard apparatus such as, for example, a disk grinder, without using considerable energy consumption, and without danger or degradation of the fibers. However, the delignification should not be extended to the point that the fibers break up by simple mechanical agitation.

Thus, the soda cooking should be stopped when the yield is between above 50 and 60% in relation to the initial plant material. The time necessary to achieve this result is between about 1 hour and about 4 hours depending on the values selected for the various parameters.

The cooked chips are next treated in a standard grinding apparatus, for example, a disk grinder, to obtain separation of the fibers by mechanical action, under conditions that preserve their integrity.

The material thus ground is subjected to a second cooking stage to carry out the delignification to a high degree under particularly advantageous and effective conditions. At least about 80% and usually at least about 90% of the lignin may be removed from the starting lignin-cellulose material. Applicants utilize the term "substantially lignin free" to characterize such pulps.

In performing this second cooking step, an aqueous peroxide alkaline solution is selected as the delignifying agent. These peroxides have the general formula:

$$R—O—O—X,$$

wherein R designates hydrogen or an alkyl radical and X is a metal ion or hydrogen. It is possible to use, within the framework of the present invention, hydrogen peroxide, sodium peroxide, or other organic or inorganic peroxides including potassium and calcium peroxides, sodium perborate, potassium and sodium persulfates, peracetic acid, perpropionic acid, perbutyric, perglutaric, persuccinic, or permaleic acid. In a preferred embodiment, hydrogen peroxide or sodium peroxide are used. The amount of peroxide used is advantageously between about 0.1% and about 10% and preferably between about 1% and about 5% calculated by weight of pure hydrogen peroxide in relation to the treated dry pulp, i.e., to 100% hydrogen peroxide.

The cooking liquor also contains from about 1% to about 10% by weight, preferably from about 2% to about 5% of sodium hydroxide in relation to the weight of the dry pulp.

The material coming from the grinding stage is cooked according to the invention with this liquor at a consistency between about 5% and about 30%, preferably between about 10% and 25% and at a temperature between 80° C. and 120° C., preferably between at a temperature of at least about 90° C., for a period of about 0.5 to about 5 hours, preferably from about 1 to about 3 hours to make sure a removal of at least 80% of the lignin from the starting lignin-cellulose material is achieved. This cooking operation is preferably performed at atmospheric pressure. Following this second cooking stage, the pulp may be processed in a standard way such as by washing with water and related processing techniques.

As the following examples will show in greater detail, the pulps obtained by the process according to the invention are chemical pulps that exhibit mechanical characteristics, including tearing index, comparable at all points with those of kraft pulps, even when the initial plant is coniferous wood. This is due to the choice of the peroxide as the delignifying agent because peroxides exert a homogeneous and particularly gentle oxidizing action on the lignin that is not accompanied by a depolymerization of the cellulose such as occurs with oxygen processing techniques.

Peroxides have been used in treating chemical paper pulps as bleaching agents. Their slight delignifying power and their instability have removed them from the field of manufacture of paper pulps, particularly chemical pulps.

Now, in an unexpected manner, the process, according to the invention, has shown that they constitute particularly advantageous cooking agents for obtaining pulps comparable to kraft pulps, because it has been found that the instability is not an obstacle to delignification of lignin-cellulose materials. Actually, the decomposition produces oxidizing species that act in turn on the lignin. However, to benefit from this advantage, it is necessary, under the best conditions, that this decomposition not occur too rapidly. The conditions to be used in the process according to the invention have been chosen as a function of this requirement.

Use of peroxide as the delignifying agent offers another significant advantage in that the peroxide also functions to bleach the pulp, which makes it possible to shorten subsequent bleaching sequences or perform subsequent stages with smaller amounts of bleaching agents, in particular chlorine containing agents.

The process according to the invention can be practiced effectively by using the peroxide alkaline solution as described above, without another additive. However, for the industrial performance to be more reliable and lead to optimal results, it can be advantageous to add to this solution additives, known in themselves, as adjuvants to the peroxide.

In a preferred embodiment of the invention, the peroxide treatment is performed in the presence of stabilizers having the effect of slowing the well known decomposition reactions of the peroxides. For this purpose, it is possible to use any of a number of compounds known for their stabilizing effect. The best known of these compounds is sodium silicate. Use of silicates, however, has the drawback of introducing silica into the combustion-generation circuits of the mill which has to be eliminated, by known treatments, from the effluent or liquid containing the silicates.

Other stabilizing agents can be used more advantageously, of which there can be cited magnesium sulfate, certain buffering agents, sodium carbonate, sodium phosphate, certain organic compounds including pyridinetrione, barbituric acid, acetalinide, pyrazole, imidazole, acridone, and the like. Numerous organic substances have been proposed as peroxide stabilizers and some particularly effective ones are now being marketed.

The increase in the effectiveness of the stabilizers put on the market will make it possible to improve the economic conditions of using the process by making it possible, for example, to work at higher temperatures using smaller amounts of peroxide.

The following examples illustrate practice of the present invention in greater detail. In the examples, as well as in the specification generally, all parts are given by weight unless indicated otherwise.

EXAMPLE 1

In a 4-liter autoclave are immersed 400 grams of industrial beech chips in about 4 times their volume of a liquor containing 17% by weight of sodium hydroxide in relation to the dry weight of the beech chips. The beech chips comprise from about 17–23% lignin. The autoclave is then introduced into a rotary boiler where heating is effected by circulation of a thermofluid whose temperature is regulated.

The autoclave is thus brought to a temperature of 170° C. in 90 minutes and kept at this temperature for 90 minutes. At the end of this period, the autoclave is cooled and the beech chips are drained. The chips are then ground by passage in a disk grinder of the Sprout Waldron type (disk C 2976) and the resulting material is washed. The yield is 53.5% and the Kappa index (standard AFNOR NF T 12018) is 50.

The ground material is mixed with a liquor containing the hydrogen peroxide cooking reagents and concentrated to a consistency of 20% by weight. The composition of the liquor is such that at the consistency of 20%, the pulp is present with the following reagents:

| Reagent | Percent by Weight* |
|---|---|
| Sodium Hydroxide | 3% |
| Sodium Silicate (commercial solution at 38° Be) | 5% |
| 100% Hydrogen Peroxide | 5% |

*(The percentages of the reagents are expressed in weight of the reagent in relation to the weight of the treated dry material).

The material thus impregnated with reagents is placed in a container where the cooking is performed for two hours at atmospheric pressure at a temperature of 90° C. After this treatment, the Kappa index of the pulp is 25 and the total yield from the cooking is 49.5%. The lignin concentration of the pulp had decreased to about 3.6%.

The mechanical characteristics of the pulp are measured by the AFNOR standards, after screening in a WEVERK laboratory screen (slots 0.15 mm) and refined in a JOKRO mill up to 40° SR. The results are summarized in Table I where there are also shown, by way of comparison, the characteristics of the kraft and soda-oxygen pulps in two stages with close Kappa indices.

As can be seen, the pulps obtained by the process according to this invention are practically equivalent to standard kraft pulps with an improved degree of whiteness.

TABLE I

| | Process According to the Invention Example 1 | BEECH Kraft Process | Two-Stage soda-oxygen Process |
|---|---|---|---|
| Kappa index AFNOR NF T 12018 | 25 | 20 | 22 |
| Yield in relation to dry plant % | 49.5 | 49 | 50 |
| Lignin removed % | 91 | | |
| Whiteness of unbleached pulp % | 38 | 22 | 40 |
| Length at rupture at 40° SR m AFNOR NF Q 03 004 | 7060 | 6500 | 6500 |
| Bursting index at 40° SR AFNOR NF Q 03 014 | 4.0 | 4.1 | 4.1 |
| Tearing index at 40° SR AFNOR Q 01 011 | 750 | 780 | 670 |

EXAMPLE 2

Industrial oak chips, comprising approximately 17–23% lignin, are treated as described in Example 1 with the exception that the first cooking stage was processed using sodium hydroxide in an amount of 19% by weight and that the second cooking stage was processed at 80° C. using hydrogen peroxide in an amount of 4% and magnesium sulfate in an amount of 0.05%.

The yield and Kappa index are determined. The lignin concentration of the pulp had decreased to about 4%. The resulting pulp is screened as above, then bleached by a bleaching sequence in five standard stages under the following conditions:

| Stage | Reagent | Amount By Weight of Reagents in Relation to Weight of Dry Pulp |
|---|---|---|
| 1 | Chlorine | 5.5% |
| 2 | Soda | 2.7% |
| 3 | Chlorine Dioxide | 1.5% |
| 4 | Soda | 1% |
| 5 | Chlorine Dioxide | 0.5% |

The characteristics of the bleached pulp are measured according to the same AFNOR standards and are summarized in Table II where, by way of comparison, the characteristics of a standard bleached kraft paper appear.

It can be seen that in an equal degree, the pulp obtained according to the present invention is equivalent to the kraft pulp, and the present pulp can therefore replace kraft paper without drawbacks, for example, in processing printing and writing paper.

TABLE II

| | OAK | | HORNBEAM | |
|---|---|---|---|---|
| Unbleached Pulp | Process According To Invention Example 2 | Kraft Process | Process According to Invention Example 3 | Kraft Process |
| Kappa index | 27 | 28 | 25 | 22 |
| yield % | 47.5 | 46 | 48 | 47 |
| Lignin removed % | 90.5 | | 91.5 | |
| Bleached Pulp | | | | |
| Whiteness % | 88.2 | 88.3 | 88.5 | 88.4 |
| Length at rupture at 40° SR m | 5800 | 5600 | 6500 | 7000 |
| Bursting index at 40° SR | 3.6 | 3.6 | 4.4 | 4.7 |
| Tearing index at 40° SR | 960 | 950 | 1020 | 850 |

EXAMPLE 3

The procedure of Example 2 is repeated except using industrial hornbeam chips having between about 17–23% lignin and the following conditions: namely, the first cooking stage used Sodium Hydroxide, 17.5% by weight; and the second cooking stage used Sodium Hydroxide, 4% by weight.

The unbleached pulp is screened and bleached as in Example 2 with the same amounts of bleaching agents. The lignin concentration of the pulp had decreased to about 3.6%. The results are summarized in Table II where the results of the kraft process appear by way of comparison.

EXAMPLE 4

The procedure of Example 2 is repeated with industrial chips of unbarked small hornbeam wood, containing 12% bark and about 17–23% lignin by weight, with the exception of the following conditions: namely, the second cooking stage used Hydrogen Peroxide, 5% by weight; and the amount of Sodium Hydroxide was 4% by weight.

The unbleached pulp is screened, then bleached as in Example 2, with the same amounts of bleaching agents. The lignin concentration of the pulp had decreased to about 4%. The results appear in Table III. The determined tearing indicies are much superior to those obtained by either kraft or soda-oxygen cooking in two stages, which probably results from the known specific action of the hydrogen peroxide on the constituents of the barks responsible for the reduction of the tearing index generally observed with the prior processes. This therefore represents an additional advantage of the present invention, in the increasingly frequent case of cooking unbarked wood chips.

EXAMPLE 5

The procedure of Example 2 was repeated using industrial chips of small oak containing 16% bark and about 17–23% lignin by weight, and the following conditions: namely, the first cooking stage used Sodium Hydroxide in an amount of 20% by weight; the second cooking stage used Sodium Hydroxide in an amount of 4% by weight. Further, the 5-stage bleaching sequence was as follows:

| Stage | Reagent | Percent by Weight |
|---|---|---|
| 1 | Chlorine | 6% |
| 2 | Soda | 3% |
| 3 | Chlorine Dioxide | 1.5% |
| 4 | Soda | 1% |
| 5 | Chlorine Dioxide | 0.7% |

The results appear in table III. The same advantages as in Example 4 are found. Additionally, the concentration of lignin had been reduced to about 4.4%.

TABLE III

| | HORNBEAM 12% BARK | | | OAK 16% BARK | |
|---|---|---|---|---|---|
| Unbleached Pulp | Process According To Invention Example 4 | Kraft | Oxygen in Two Stages | Process According to Invention Example 5 | Kraft |
| Kappa index | 28 | 27 | 21 | 30 | 28 |
| Yield % | 44 | 43 | 44 | 42.5 | 41.5 |
| Lignin removed % | 91 | | | 90.5 | - |
| Bleached Pulp | | | | | |
| Whiteness % | 90 | 88 | 88 | 89 | 88 |
| Length at rupture at 40° SR m | 6400 | 7000 | 6500 | 4600 | 4900 |
| Bursting index at 40° SR | 4.5 | 4.3 | 4.5 | 4.3 | 3.6 |

TABLE III-continued

| Unbleached Pulp | HORNBEAM 12% BARK | | | OAK 16% BARK | |
|---|---|---|---|---|---|
| | Process According To Invention Example 4 | Kraft | Oxygen in Two Stages | Process According to Invention Example 5 | Kraft |
| Tearing index at 40° SR | 950 | 780 | 830 | 960 | 820 |

As said above, the pulps proposed so far was replacement of the kraft pulps in the field of wrapping were not satisfactory because of their insufficient tearing index. The principally involved coniferous pulps are useful for liners.

In Examples 6 and 8 above, the process according to the present invention was performed with chips of spruce and sea pine.

EXAMPLE 6

Example 1 is repeated using industrial spruce chips, with the exception of the following conditions: namely, the first cooking stage used Sodium Hydroxide in an amount of 22% by weight; the second cooking stage is processed at a cooking temperature of 80° C. and a cooking time of 90 min.

The resulting pulp is screened in a WEVERK laboratory screen (slots 0.30 mm) and refined in a JOKRO mill to 20° SR. The mechanical characteristics of the pulp appear in Table IV where they are compared with the mechanical characteristics of kraft and two-stage soda-oxygen pulp. The comparison shows that the process according to the present invention is more suited to making pulp for liners.

TABLE IV

| | SPRUCE | | | |
|---|---|---|---|---|
| | Process According To Invention (with silicate) Example 6 | Kraft | Two-Stage Soda-Oxygen | Process According to Invention (with carbonate) Example 7 |
| Kappa index | 77 | 70 | 78 | 76 |
| Yield % | 49 | 49 | 51 | 49 |
| Length at rupture at 20° SR m | 5650 | 6100 | 6200 | 6200 |
| Bursting index at 20° SR | 4.1 | 5.1 | 4.4 | 4.1 |
| Tearing index at 20° SR | 1000 | 950 | 930 | 1050 |

EXAMPLE 7

Example 6 is repeated with the exception of the following conditions: namely, the first cooking stage used Sodium Hydroxide in an amount of 23% by weight; and in the second cooking stage the Sodium Silicate is replaced with Sodium Carbonate.

The amounts of reagents used are the following (in weight in relation to the weight of the treated dry material):

| Reagent | Percent by Weight |
|---|---|
| Hydrogen Peroxide | 2% |
| Sodium Hydroxide | 4% |
| Sodium Carbonate | 4% |

A pulp is obtained useful for liners whose mechanical characteristics are shown in Table IV.

EXAMPLE 8

Example 1 is repeated using industrial sea pine chips with the exception of the following conditions: namely, the first cooking stage used Sodium Hydroxide in an amount of 23% by weight; the second cooking stage used Sodium Hydroxide in an amount of 4% by weight and the cooking temperature was 80° C. over a cooking time of 90 min.

A pulp useful for liners whose mechanical characteristics measured at 20° SR, are given in Table V and where they are compared with the mechanical characteristics of soda-oxygen and kraft pulps.

TABLE V

| | SEA PINE | | |
|---|---|---|---|
| | Process According to Invention Example 8 | Soda-Oxygen Cooking | Kraft Cooking |
| Kappa index | 60 | 65 | 60 |
| Yield % | 48.5 | 49 | 48.5 |
| Length at rupture at 20° SR | 6700 | 5700 | 6800 |
| Bursting index at 20° SR | 4.6 | 4.6 | 5.0 |
| Tearing index at 20° SR | 1160 | 1000 | 1140 |

EXAMPLE 9

Under conditions identical with those of Example 1, 400 grams of industrial sea pine chips are treated, having about 25–32% lignin, but with the following amounts of reagents: namely, the first cooking stage used Sodium Hydroxide in an amount of 19.5% by weight and Anthraquinone in an amount of 0.08% by weight. The second cooking stage used Sodium Hydroxide in an amount of 3% by weight, 100% Hydrogen Peroxide in an amount of 0.5% by weight, and Magnesium Sulfate in an amount of 0.5% by weight.

It should also be noted that grinding of the material between the two stages can be performed in an apparatus consuming relatively little energy, given the well known action of anthraquinone in delignification. The characteristics of the resulting pulp are summarized in Table VI. The amount of lignin in the composition had been reduced to about 4.7%.

This pulp is then bleached by a 5-stage standard bleaching sequence with the following amounts of reagents (by weight in relation to the weight of dry pulp):

| Stage | Reagent | Percent by Weight |
|---|---|---|
| 1 | Chlorine | 6.3% |
| 2 | Soda | 3.1% |
| 3 | Chlorine Dioxide | 1% |
| 4 | Hydrogen Peroxide $H_2O_2$ | 0.5% |
| | NaOH | 1% |
| | Sodium Silicate | 3% |
| 5 | Chlorine Dioxide | 0.5% |

The characteristics of the bleached pulp, measured by the same AFNOR standard are summarized in Table VI.

TABLE VI

| Example 9: | End of 1st Stage | End of 2nd Stage | After Bleaching |
|---|---|---|---|
| Kappa index | 50.7 | 32 | — |
| Yield % | 45.3 | 44 | — |
| Lignin removed % | | 93 | |
| Whiteness | — | — | 38 |
| Length at rupture m | — | 7020 | 8410 |
| Bursting index | — | 5.35 | 5.54 |
| Tearing index | — | 904 | 1045 |

It can be seen that bleaching applied to chemical pulps obtained according to this embodiment of the process of the present invention results in a high degree of whiteness, and a particularly important increase of the mechanical charateristics, including the tearing index.

To achieve equivalent mechanical characteristics for a bleached pulp obtained from the same starting plant by a single stage soda cooking process, it would be necessary to add about 1.28% anthraquinone to the 19.5% sodium hydroxide. Under such conditions, the degree of whiteness achieved would be about 4 points lower.

It has already been proposed to subject the lignin-cellulose materials to a first sodium hydroxide cooking stage to which anthraquinone has been added, followed by a second oxygen cooking stage. By this means, there is obtained, after bleaching, a high level of whiteness and mechanical characteristics. However, the tearing index is still below that obtained with a second peroxide stage, as shown in Examples 1 to 8. This has a considerable drawback for use of these pulps in wrapping papers.

EXAMPLE 10

400 grams of sea pine chips having about 25–32% lignin are treated under conditions identical with those of Example 1, with the exception that the amounts of reagents used in the second stage are as follows:

| Reagent | Percent by Weight |
|---|---|
| Hydrogen Peroxide | 0.3% |
| Sodium Hydroxide | 4.5% |

A pulp is obtained with a Kappa index 35, which shows a very good aptitude for bleaching. The yield is 45% and the lignin had been reduced to about 5.1%, which shows that about 92% of the lignin present in the chips has been removed.

It can be seen that the process according to the present invention makes it possible to obtain, in relatively short periods, from any lignin-cellulose material and without excessive consumption of chemical reagents, homogeneous raw chemical pulps with a satisfactory yield exhibiting mechanical properties at least as good as those of kraft pulp. Furthermore, this can be effected by completely eliminating the pollution problems associated with the standard chemical pulpmaking processes, and without bringing in new pollution problems.

The composition obtained by the use of applicants' process, while it does not produce a lignin-free pulp does generate a highly delignified pulp, as evidenced by the preceding Examples. The hardwoods treated by applicants' process (e.g., beech, oak, hornbeam, etc.) comprised about 17–23% lignin by weight prior to treatment and from 3.6%–4.4% after treatment while the lignin concentration of the softwoods (e.g. spruce, sea pine, etc.) decreased from an original range of about 25–32% lignin to about 4.7–5.1% lignin subsequent to such treatment. These values were determined through the use of the formula: Kappa Index$\times$0.14=% lignin by weight, as disclosed in *Pulp and Paper, Chemistry and Chemical Technology,* 3rd ed., Vol I, p.665. This reduction of approximately 80% in the lignin concentration with a corresponding percentage of lignin removed of at least about 90% only occurred definitely, however, when the second cooking stage was carried out at at least 90° C. for a minimum of 2 hours (see, e.g., examples 1–5 and 9–10). A reduction in either the temperature used or in the length of time in which the second heating step is carried out does not result in a reduction in lignin concentration of the magnitude described above.

The present invention thus offers, over non-polluting processes proposed so far, the advantage of being perfectly suited for treating coniferous woods to replace kraft pulps intended for wrapping papers. This has not been the case, particularly for processes using oxygen in the second cooking stage.

The effectiveness of the present invention is also remarkable in the treatment of young unbarked woods, because of the particular oxidizing action of the peroxide on the constituents of the barks.

Further, the present invention offers, in comparison with the soda-oxygen processes, considerable advantages.

Actually, the process according to the invention, comprising only a single cooking stage under pressure, can be used with standard equipment, essentially comprising a boiler, a device for performing mechanical grinding and a simple tower in which the peroxide cooking stage will be performed.

Moreover, the use of the oxidizing agent in solution eases the operation of the plant by eliminating the dangers of explosion, considerable releases of CO and $CO_2$ and the need of working with an excess of reagent which involves a certain loss of said reagent.

These advantages make it possible to consider industrial exploitation of the process, both to replace standard processes for making chemical pulps, particularly the kraft process, without prohibitive investments, and to install new small and medium size units suited to using local natural resources of lignin-cellulose raw materials under favorable economic conditions. This is particularly advantageous when using the variation of the process where to the first sodium hydroxide stage are added adjuvants such as anthraquinone. Additionally to the advantages indicated above, may be added advantages that come out more particularly from their variant, namely: slight consumption of energy for grinding; use of small amounts of peroxides; advantageous cost due to a low consumption of costly reagents such as peroxide, anthraquinone, or the like; and the obtaining of chemical pulps which, after bleaching, exhibit a series of optical and mechanical characteristics that are high level, which allow them to replace bleached kraft pulps.

From the foregoing, it will be readily apparent to those skilled in the art that various modifications and changes may be effected without departing from practice of the presently disclosed invention.

What is claimed is:

1. A process of making chemical paper pulps by delignification of lignin-cellulose material which comprises:

(a) subjecting the lignin-cellulose material to a first cooking stage performed in the presence of an aqueous sodium hydroxide solution containing between about 10 and 30% of sodium hydroxide by weight of the dry initial material and at a temperature between about 150° and 180° C. until the yield of cooked material is between about 50 and 60% by weight of the dry initial material to partially delignify the material;

(b) grinding the material thus treated; and (c) subjecting the material thus ground to a second cooking stage performed at a temperature in the range of from about 90° C. to 120° C. in the presence of an aqueous solution of a peroxide, sodium hydroxide and a peroxide stabilizing agent which is present in an amount sufficient to slow but not prevent the decomposition of the peroxide into oxidizing species and wherein the amount of peroxide is between about 0.1 and 10% by weight of the dry ground material and the amount of sodium hydroxide is between about 1 and 10% by weight of the dry ground material, for a sufficient time to further delignify the material, the combination of steps (a), (b) and (c) removing at least about 80% of the lignin from the material, thus forming a chemical paper pulp.

2. The process according to claim 1 wherein the peroxide is hydrogen peroxide or alkaline peroxide.

3. The process according to claim 2 wherein the amount of peroxide in the aqueous peroxide alkaline solution of the second cooking stage is between about 1 and 5% by weight of the dry ground material.

4. The process according to claim 3 wherein the amount of sodium hydroxide in the aqueous peroxide alkaline solution of the second cooking stage is between about 2 and 5% by weight of the dry ground material.

5. The process according to claim 1 wherein the second cooking stage is performed for between about 0.5 and 5 hours.

6. The process according to claim 1 wherein the second cooking stage is performed for between about 1 and 3 hours.

7. The process according to claim 1 wherein the second cooking stage is performed at atmospheric pressure.

8. The process according to claim 1 wherein the aqueous sodium hydroxide solution of the first cooking stage contains an adjuvant.

9. The process according to claim 8 wherein the adjuvant is an aromatic nitro derivative, a nitrogen heterocyclic compound of the phenazine type or a cyclic ketone of the anthraquinone type.

10. The process according to claim 9 wherein the adjuvant is anthraquinone.

11. The process according to claim 10 wherein the amount of adjuvant present is between about 0.01 and 0.2% by weight of the dry initial material.

12. The method of claim 1 wherein the combination of steps (a), (b) and (c) removes at least 90% of the lignin from the material.

13. A process of making chemical paper pulps by delingnification of lignin-cellulose material which comprises:

(a) subjecting the lignin-cellulose material to a first cooking stage performed in the presence of an aqueous sodium hydroxide solution containing between about 10 to 30% of sodium hydroxide and an adjuvant of an aromatic nitro derivative, a nitrogen heterocyclic compound of the phenazine type, or a cyclic ketone of the anthraquinone type in an amount of between about 0.01 and 0.2%, each amount based on percent by weight of the dry initial material, at a temperature between about 150° and 180° C. to partially delignify the material to a yield of between about 50 and 60% by weight of the dry initial material;

(b) grinding the material thus treated; and (c) subjecting the material thus ground to a second cooking stage performed at a temperature in the range of from about 90° C. to 120° C. in the presence of an aqueous solution of a peroxide, sodium hydroxide and a peroxide stabilizing agent which is present in an amount sufficient to slow but not prevent the decomposition of the peroxide into oxidizing species and wherein the amount of peroxide is between about 1 and 5% by weight of the dry ground material and the amount of sodium hydroxide is between about 2 and 5% by weight of the dry ground material for a sufficient time to further delignify the material, the combination of steps (a), (b) and (c) removing at least about 90% of the lignin from the lignin-cellulose material, thus forming a chemical paper pulp.

14. A process of making chemical paper pulps by delingnification of ligin-cellulose material which comprises:

(a) subjecting the lignin-cellulose material to a first cooking stage performed in the presence of an aqueous sodium hydroxide solution containing between about 10 and 30% of sodium hydroxide by weight of the dry initial material and at a temperature between about 150° and 180° C. to partially delignify the material to a yield of between about 50 and 60% by weight of the dry initial material;

(b) grinding the material thus treated; and (c) subjecting the material thus ground to a second cooking stage performed at a temperature of above about 90° C. for at least 2 hours in the presence of an aqueous solution of the peroxide, sodium hydroxide and a peroxide stabilizing agent which is present in an amount sufficient to slow but not prevent the decomposition of the peroxide into oxidizing species and wherein the amount of peroxide is between about 0.1 and 10% by weight of the dry ground material and the amount of sodium hydroxide is between about 1 and 10% by weight of the dry ground material to further delignify the material, the combination of steps (a), (b) and (c) removing at least about 80% of the lignin from the lignin-cellulose material, thus providing a substantially lignin-free chemical paper pulp.

15. The method of claim 14 wherein the combination of steps (a), (b) and (c) removes at least 90% of the lignin from the material.

* * * * *